US006085913A

United States Patent [19]

Aiko et al.

[11] Patent Number: 6,085,913

[45] **Date of Patent: *Jul. 11, 2000**

[54] SHEET STACKING APPARATUS CAPABLE OF SHIFTING SHEETS ON BINS

[75] Inventors: Yasuyuki Aiko, Yokohama; Satoshi Kuroyanagi, Tokyo; Mitsuhiko Sato, Kawasaki; Masahito Yamamoto, Yokohama; Yoshihito Osari, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/497,466

[22] Filed: Jun. 30, 1995

[30] Foreign Application Priority Data

Jul. 6, 1994 [JP] Japan ..... 6-154665

[51] Int. Cl.[7] ..... B07C 5/02; B65H 39/10

[52] U.S. Cl. ..... 209/540; 209/900; 271/221; 271/292; 270/58.14; 270/58.27

[58] Field of Search ..... 209/539, 540, 209/586, 900; 271/176, 220, 221, 222, 288, 292; 270/58.02, 58.08, 58.09, 58.14, 58.27

[56] References Cited

U.S. PATENT DOCUMENTS

| | | | |
|---|---|---|---|
| 5,236,072 | 8/1993 | Cargill | 209/586 X |
| 5,382,016 | 1/1995 | Kobayashi et al. | 271/221 X |
| 5,556,251 | 9/1996 | Hiroi et al. | 270/58.19 X |
| 5,836,579 | 11/1998 | Hayashi et al. | 270/58.16 |

FOREIGN PATENT DOCUMENTS

| | | | |
|---|---|---|---|
| 3102070 | 4/1994 | Japan | 271/221 |

*Primary Examiner*—Tuan N. Nguyen
*Attorney, Agent, or Firm*—Fitzpatrick, Cella, Harper & Scinto

[57] ABSTRACT

In an image forming apparatus such as a copying machine or the like having a sorter with a plurality of paper ejection bins, there is provided a sorter apparatus which can efficiently execute a dividing and sorting operations for every work irrespective of a size and a direction of sheets, the presence or absence of a sheet stapler, a remaining state in the sheet sorter apparatus, or the like. A recycle automatic document feeder (RDF) for automatically feeding originals, a sorter, an aligning bar and a reference bar in a sorter bin, and the like are provided. When a length of sheet exceeds a predetermined value, the movement of the sheets by the reference bar is inhibited.

23 Claims, 11 Drawing Sheets

SHEET STACKING APPARATUS CAPABLE OF SHIFTING SHEETS ON BINS

BACKGROUND OF THE INVENTION

1. Field of the Invention

The invention relates to a sorter apparatus which can shift a sheet on a bin.

2. Related Background Art

Hitherto, there is a copying apparatus or the like having a sorter with a plurality of sheet ejection bins. As is well known, according to such a sorter, when a plurality of originals are copied or a plurality of number of copies are performed, by individually ejecting the sheets to the bins, the sheets can be sorted and bound.

However, the conventional sorter has a drawback such that the sorting and binding operations of the number exceeding the number of bins provided cannot be performed. There is also a drawback such that when a size of sheet ejected is small, the sheet is difficult to be taken out. Such a sorter generally has a construction such that the sheet is taken out from the lateral side and doesn't have a construction such that the sheet can be easily taken out from the front side.

SUMMARY OF THE INVENTION

It is an object of the invention to provide a sorter apparatus which can solve the above problems. Another object of the invention is to provide a sorter apparatus in which a sheet of any size can be easily taken out.

Still another object of the invention is to provide a sorter apparatus in which a sheet can be taken out from either one of the front side and the lateral side.

DETAILED DESCRIPTION OF THE PREFERRED EMBODIMENTS

The invention will now be described hereinbelow on the basis of a plurality of embodiments.

[Embodiment 1]

Figure 1:
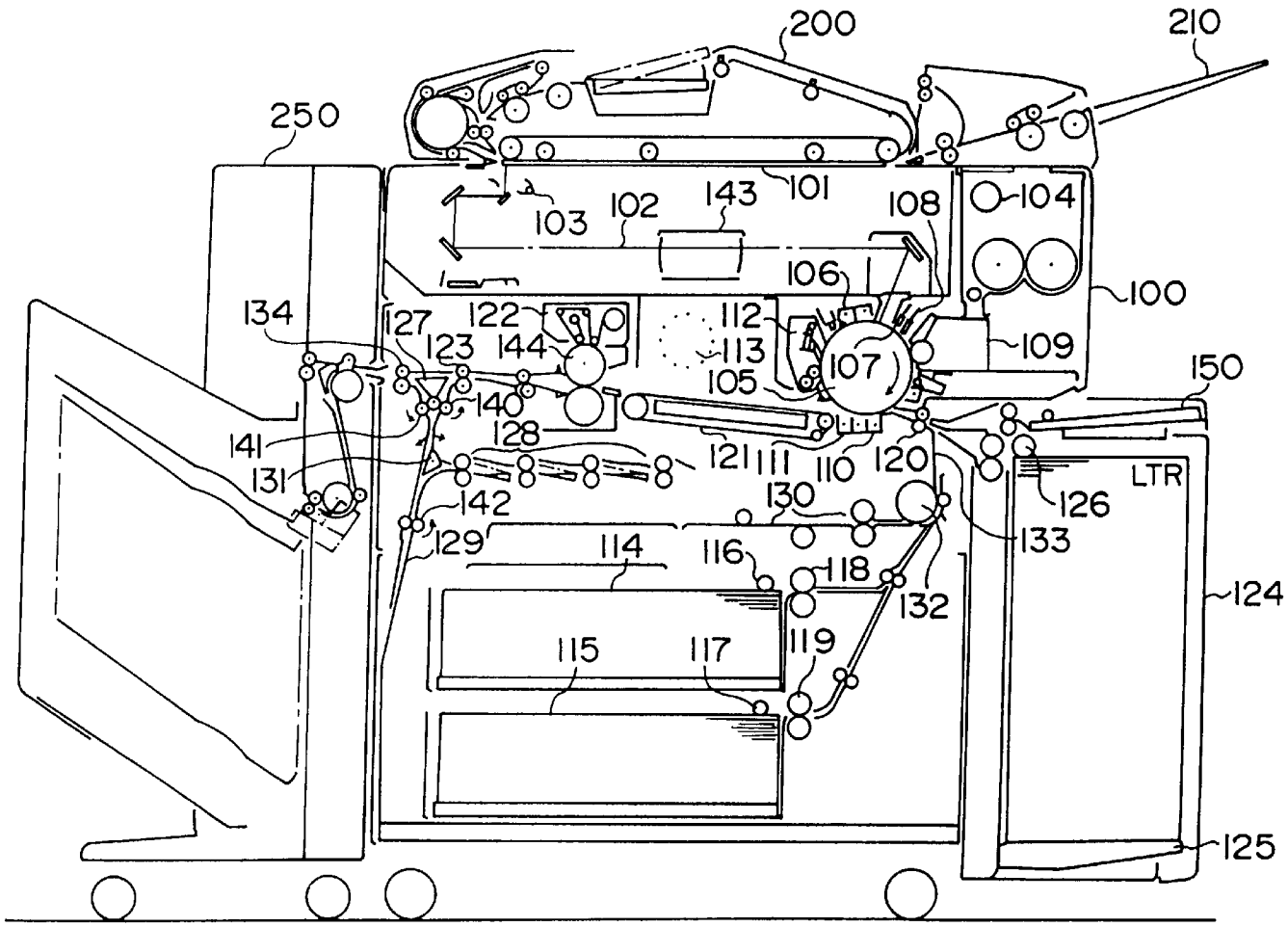
FIG. 1 is a schematic cross sectional constructional diagram of an example of a copying apparatus of the embodiment 1.

FIG. 1 first shows a schematic cross sectional constructional view of a copying apparatus according to the first embodiment showing most preferably a feature of the invention. In FIG. 1, reference numeral 100 denotes a copying apparatus main body; 200 a recycle automatic document feeder (hereinafter, referred to as an "RDF") for automatically feeding an original; and 250 a sorting device, namely, a sorter. The RDF 200 and sorter 250 are constructed so that they can be freely combined with the main body 100 and are used.

Reference numeral 101 denotes an original supporting glass plate serving as an original mounting base plate. An original is put on the glass plate 101 manually by the user or automatically by the RDF 200. Reference numeral 102 denotes an optical system serving as image reading means comprising an original illuminating lamp (exposure lamp) 103, a scan mirror, a lens, a motor 104, and the like. While scanning the optical system 102 by the motor 104, the original is illuminated by the exposure lamp 103. The reflected light from the original is irradiated onto a photosensitive drum 105 by the scan mirror and lens.

A high voltage unit 106, a blank exposure unit 107, a potential sensor 108, a developing device 109, a transfer charging device 110, a separation charging device 111, and a cleaning device 112 are arranged around the photosensitive drum 105. Image recording means is constructed by those photosensitive drum 105 and the like.

The photosensitive drum 105 is rotated in the direction shown by an arrow in FIG. 1 by a main motor 113 and is corona charged by the high voltage unit 106. When the reflected light from the original is irradiated from the optical system 102, an electrostatic latent image is formed on the drum 105. The electrostatic latent image is developed by the developing device 109 and is visualized as a toner image.

A transfer paper (sheet) is picked up from an upper stage cassette 114 or a lower stage cassette 115 and is conveyed into the main body 100 by a paper feed roller 118 or 119 through a pickup roller 116 or 117. A timing of the transfer paper is matched by a registration roller 120 so that a front edge of a toner image coincides with a front edge of the transfer paper. After that, the transfer paper is fed to the photosensitive drum 105. The toner image is transferred by the transfer charging device 110.

After the toner image was transferred, the transfer paper is separated from the photosensitive drum 105 by the separation charging device 111 and is led to a fixing device 122 by a conveying belt 121 and is fixed by applying a pressure and a heat. After that, the transfer paper is ejected out of the main body 100 by an ejection roller 123. The surface of the photosensitive drum 105 is cleaned by the cleaning device 112. A paper deck 124 which can enclose, for example, 4000 transfer papers is attached to the main body 100. A lifter 125 of the deck 124 is lifted up in accordance with a quantity of transfer papers so that the top transfer paper always comes into contact with a paper feed roller 126.

Reference numeral 127 denotes a paper ejection flapper for switching a path on the two-sided recording side or multiplex recording side and a path on the ejecting side (sorter 250). The transfer paper fed out from the ejection roller 123 is switched to the two-sided recording side or multiplex recording side by the paper ejection flapper 127.

Reference numeral 128 denotes a lower conveyance path for reversing the transfer paper fed out from the ejection roller 123 upside down through a reversing path 129 and guides the reversed paper to a paper refeed tray 130. Reference numeral 131 denotes a multiplex flapper for switching the path on the two-sided recording side and the path on the multiplex recording side. By dropping the multiplex flapper 131 to the left, the transfer paper is directly guided to the lower conveyance path 128 without passing through the reversing path 129.

Reference numeral 132 denotes a paper feed roller for feeding the transfer paper to the photosensitive drum 105 side through a path 133. Reference numeral 134 denotes an ejection roller, arranged near the paper ejection flapper 127, for ejecting the transfer paper switched to the ejecting side by the ejection flapper 127 to the outside of the apparatus main body.

In the two-sided recording (two-sided copy) or multiplex recording (multi-copy) mode, the ejection flapper 127 is lifted upward and the transfer paper which has already been copied to the paper refeed tray 130 through the conveying paths 129 and 128 in an upside-down state. In this instance, the multiplex flapper 131 is dropped to the right in the two-sided recording mode and is fallen down to the left in the multiplex recording mode. In the backside recording mode or multiplex recording mode to be executed next, the transfer papers stored in the paper re-feed tray 130 are guided one by one from the lower side to the registration roller 120 of the main body 100 through the path 133 by the paper feed roller 132.

When the transfer paper is reversed and ejected out from the main body 100, the ejection flapper 127 is lifted up, the flapper 131 is dropped to the right, and the copied transfer paper is conveyed to the conveying path 129 side. After the rear edge of the transfer paper passed through a first feed roller 140, the transfer paper is conveyed to a second feed roller 141 side by a reversing roller 142. The transfer paper is reversed upside down by the ejection roller 134 and is ejected to the outside of the apparatus main body. Reference numeral 150 denotes a multi-hand inserting section and 210 indicates a reservation tray.

Figure 2:
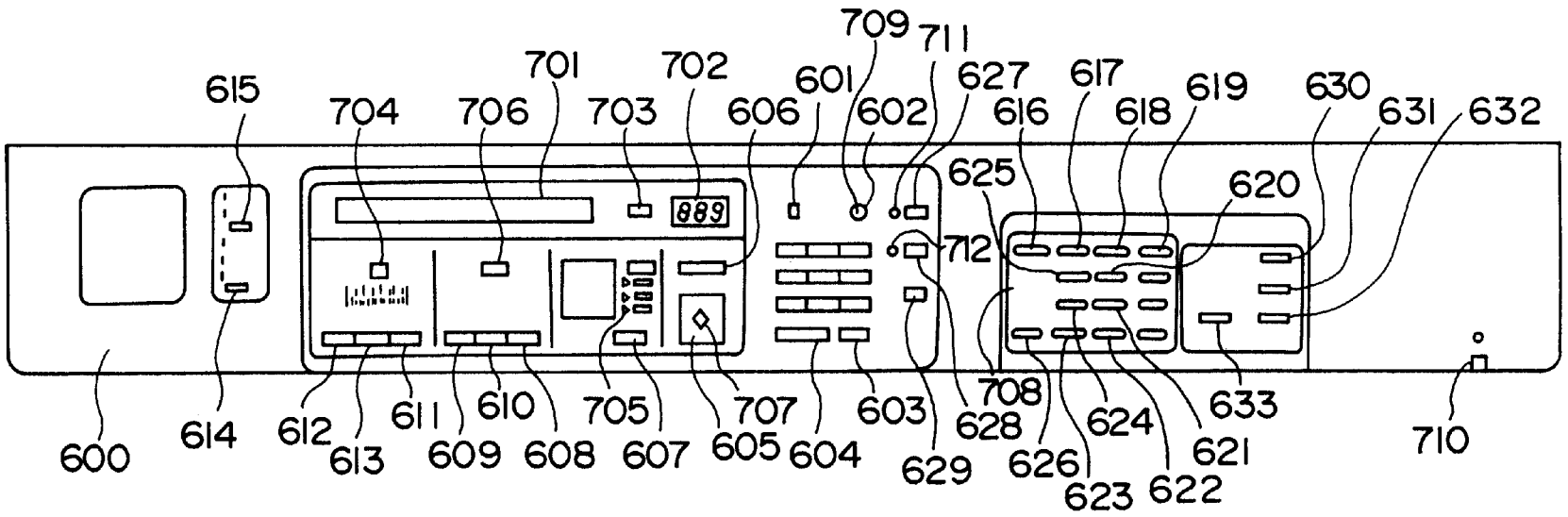
FIG. 2 shows an example of a construction of an operation panel arrangement of FIG. 1.

FIG. 2 shows an example of an arrangement construction of a console panel 600 provided for the main body 100 in FIG. 1. In FIG. 2, reference numeral 601 denotes an asterisk (*) key which is used by the operator (user) in a setting mode to set a binding margin amount, a size for original trimming, or the like; 627 a cursor key which is used to select set items in the setting mode; and 628 an OK key which is used to decide the set contents in the setting mode.

Reference numeral 606 denotes an all reset key which is depressed when the copy mode is returned to the standard mode. The key 606 is also depressed when returning from the all shut-off state to the standard mode. Reference numeral 605 denotes a copy start key which is depressed when starting the copying operation; and 604 indicates a clear/stop key having a function of a clear key in the standby mode and a stop key during the copy recording operation. The clear key is also used when cancelling the set copy number. The stop key is depressed when interrupting the serial copy mode. After the copying operation at a time point of the depression of the stop key was finished, the copying operation is stopped.

Reference numeral 603 denotes a ten-key which is depressed when setting the copy number and is also used when setting the asterisk (*) mode; and 619 indicates a memory key. The user can register modes which are frequently used by the user by setting the memory key 619. Four kinds of modes M1 to M4 can be registered here.

Reference numerals 611 and 612 denote copy density keys which are depressed when the user manually adjusts a copy density; and 613 indicates an AE (automatic exposure adjustment) key which is depressed when the copy density is automatically adjusted in accordance with a density of an original or when the AE (automatic density adjustment) is cancelled and the density adjustment is switched to the manual mode. Reference numeral 607 denotes a copy sheet select key which is depressed when the upper stage cassette 114, lower stage cassette 115, paper deck 124, and multi-hand inserting section 150 are selected in FIG. 1. When originals are put in the RDF 200, an APS (automatic paper cassette selection) can be selected by the key 607. When the APS is selected, the cassette of the same size as the original is automatically selected.

Reference numeral 610 denotes a direct copy key which is depressed when copying at the equal magnification (original size); 616 an auto zoom key which is depressed when designating a process to automatically reduce or enlarge an image of an original in accordance with a size of the designated transfer paper; 626 a two-sided copy key which is depressed when obtaining a two-sided copy from a one-sided original, a two-sided copy from a two-sided original, or a one-sided copy from a two-sided original; 625 a binding margin key which is depressed when forming a binding margin of a designated length to the left side of the transfer paper; and 624 a photograph key which is depressed when copying a photograph original.

Reference numeral 623 denotes a multiplex key which is depressed when forming (synthesizing) images on the same side of the transfer paper from two originals; and 620 indicates an original trimming key which is depressed when the user executes a trimming of an original of a regular size. In this instance, the size of original is set by the asterisk key 601. Reference numeral 621 denotes a sheet trimming key which is depressed when trimming the original in accordance with a size of copy paper; 629 a cover mode set key which is depressed when forming a front cover and a back cover and inserting an interleaf paper; and 630 a serial page copy key which is depressed when continuously copying the left and right pages of a double-spread book.

Reference numeral 614 denotes an ejecting method select key for selecting an ejecting method of a staple sort, a sort, and a group. When the staple sorter is connected for the papers after recording, either one of the staple sort mode, sort mode, and group mode can be selected or the selected mode can be cancelled. Reference numeral 631 denotes a reservation key which is depressed when starting the setting of the copy mode for a reserved original put on the reservation tray 210 in FIG. 1 and when cancelling the reservation set; 632 a reservation set key which is used as a decision key when the reservation mode is set; and 633 a guide key which is depressed to display messages for explaining functions corresponding to various kinds of keys to a message display.

Reference numeral 701 denotes a message display of an LCD (liquid crystal display) type to display information about the copy by characters or a figure by (96×192) dots. For example, the display 701 displays a copy number set by the ten-key 603, a copy magnification set by regular-size zoom keys 608 and 609, the direct copy key 610, and zoom keys 617 and 618 which was set by the ten-key 603, a paper size selected by the copy sheet select key 607, a message indicative of a state of the copying apparatus main body 100, a guide message indicative of an operation procedure, and other set contents of various kinds of modes. Reference numeral 704 denotes an AE display which is lit when the AE (automatic exposure adjustment) is selected by the AE key 613; and 709 indicates a preheat display which is lit in a preheat mode.

When the RDF 200 is used in the standard mode, the copy number is set to one copy, and the density AE mode, the automatic paper selection, the direct copy mode, and the one-sided copy from the one-sided original are set. In the standard mode when the RDF 200 is not used, the copy number is set to one copy, and the density manual mode, the direct copy mode, and the one-sided copy from the one-sided original are set. A difference between the case where the RDF 200 is used and the case where it is not used is determined in dependence on whether the originals have been set in the RDF 200 or not.

Figure 3:
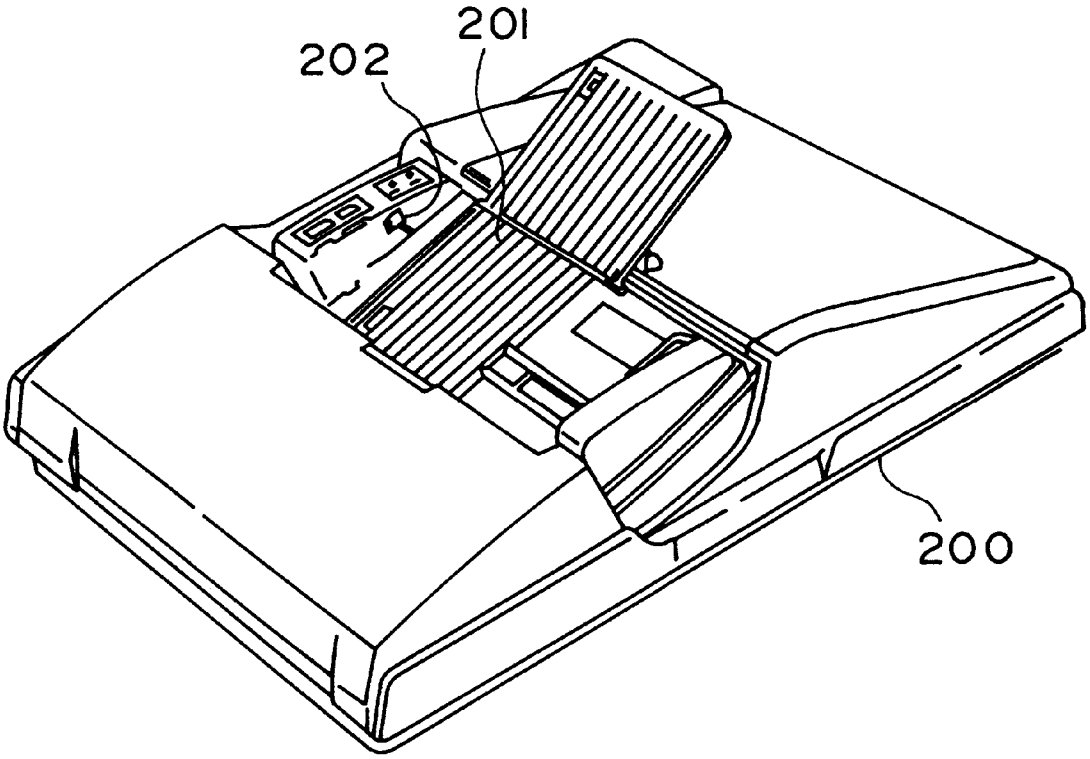
FIG. 3 is a perspective view of an RDF.

FIG. 3 is an explanatory diagram of the RDF 200. Reference numeral 201 denotes an original stacking section and 202 indicates an original detecting sensor.

FIGS. 4A to 4D are diagrams when the sorter 250 is seen from the upper position. An aligning bar 252 and a reference bar 253 are provided in a notch of a sorter bin 251 and are extended in the vertical direction. The aligning bar 252 and reference bar 253 can be moved in the directions shown by arrows by the driving of a motor or a solenoid (not shown). By the holding positions and motions of the aligning bar 252 and reference bar 253, the sheet ejected onto the sorter bin 251 is aligned or the sheet is moved to a position on the sorter bin 251 at which the operator can easily take out the sheet. A sorter outer frame 258 is extended in the vertical direction on the outside of the sorter bin 251.

The movement of the sheet on the sorter bin 251 will now be described with reference to FIGS. 4A, 4B, 4C, and 4D.

[FIG. 4A]

Sheets A on which the original images were recorded are ejected onto the sorter bin 251. When the sheet is ejected, the reference bar 253 is located at a position Y. Each time one sheet is ejected, the aligning bar 252 is moved to the position Y and is returned to a position X.

[FIG. 4B]

When the ejection of the sheets of one group is finished, the reference bar 253 is returned to the position X and the aligning bar 252 is moved to a position Z. The sheet is moved on this side.

[FIG. 4C]

The aligning bar 252 is held at the position Z, the reference bar 253 is moved to the position Y, and the sheet is deviated.

[FIG. 4D]

Figure 4A:
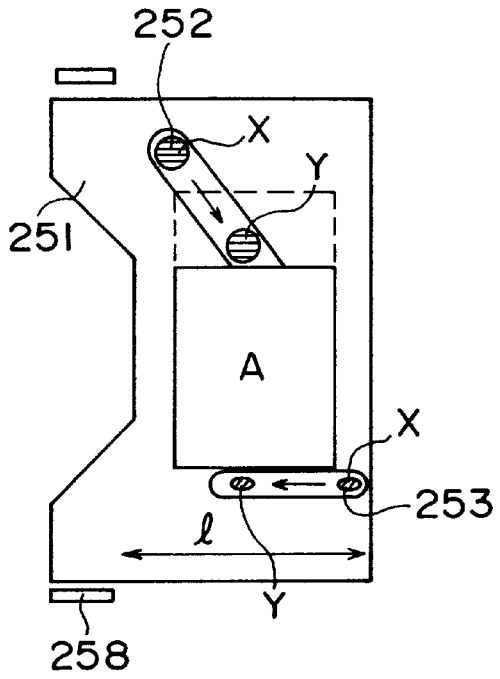
FIGS. 4A to 4D are operation explanatory diagrams of a sorter.
Figure 4C:
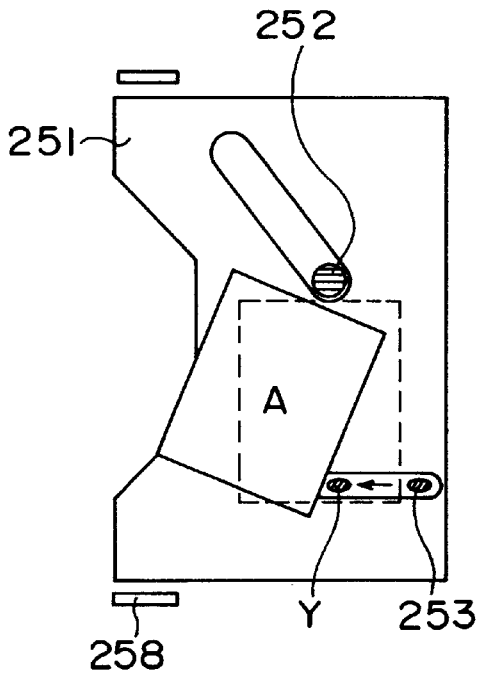
Figure 4B:
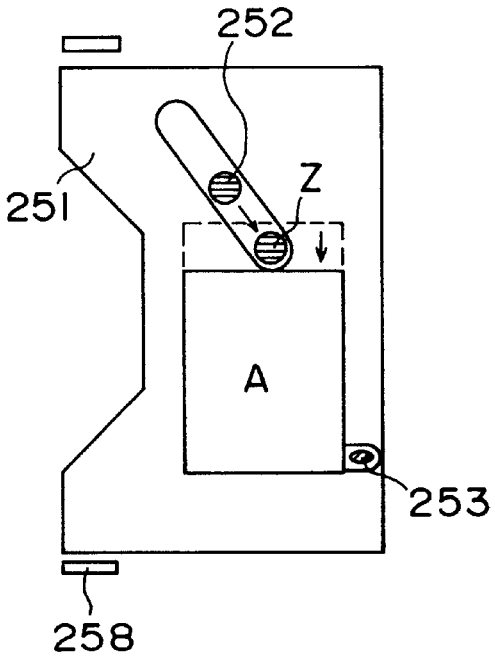
Figure 4D:
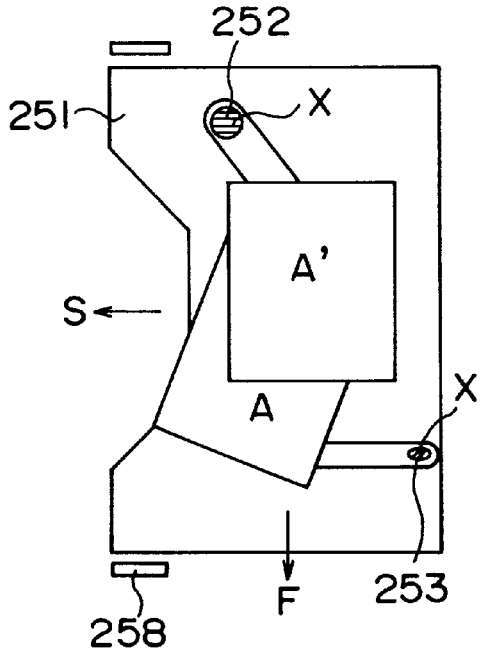

The aligning bar 252 and reference bar 253 are moved to the position X, respectively. After that, the ejection of the sheets A' is permitted. The sheets A which were deviated as shown in FIG. 4D are in a state in which they can be easily taken out from the front-side direction F.

Figure 5:
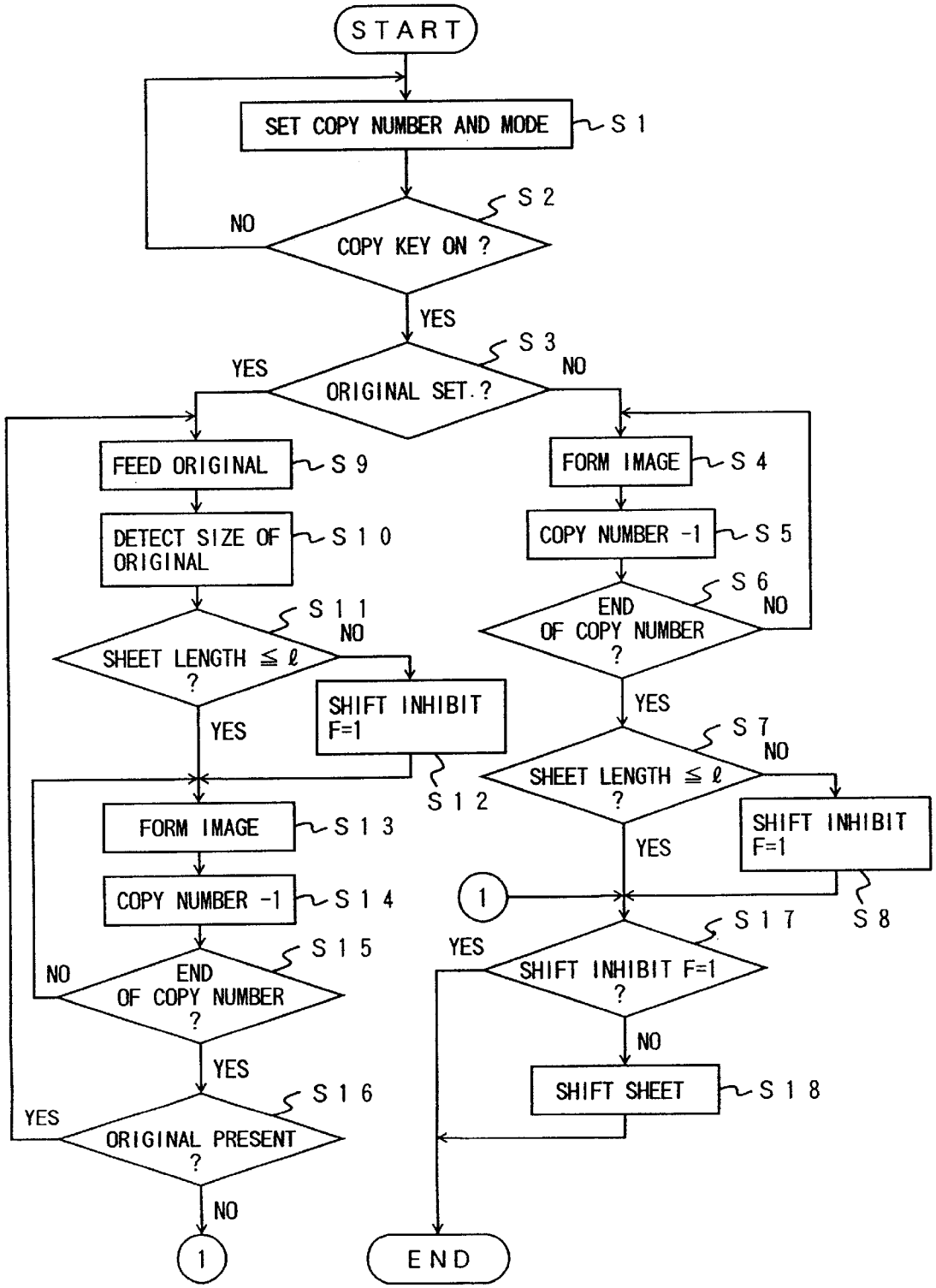
FIG. 5 is an operation sequence flowchart of the embodiment 1.

An operation sequence of the embodiment will now be described with reference to a flowchart of FIG. 5.

First, a predetermined operation mode and a copy number are set by the console panel 600 (step S1). Subsequently, the depression of the copy start key 605 is detected (step S2). A check is made to see if the originals have been set in the RDF 200 or not by a sensor provided for the RDF 200 (step S3).

When the absence of the originals in the RDF 200 is detected, it is judged that the copy mode is set to the copy operation mode in which the RDF 200 is not used, so that the foregoing image forming sequence is executed (step S4). The number of copies which was set before is counted down and the image forming process is repeated until the count value reaches a desired copy number (steps S5, S6). After completion of the copy of the desired copy number, in the case where a length of the ejected sheet is longer than a predetermined value l, a sheet movement inhibition flag is set (steps S7, S8).

On the other hand, when the originals have been set in the RDF 200, it is judged that the operating mode is the automatic document feed mode by the RDF 200. The first original is first fed (step S9). In this instance, a size of original is detected (step S10). When a length of sheet of the size decided from the operating mode which was set before is longer than the predetermined value l, the sheet movement inhibition flag is set (steps S11, S12). After that, the image forming sequence is executed (step S13). The copy number which was set before is counted down and the image forming process is repeated until the count value reaches a desired copy number (steps S14, S15).

Figure 6A:
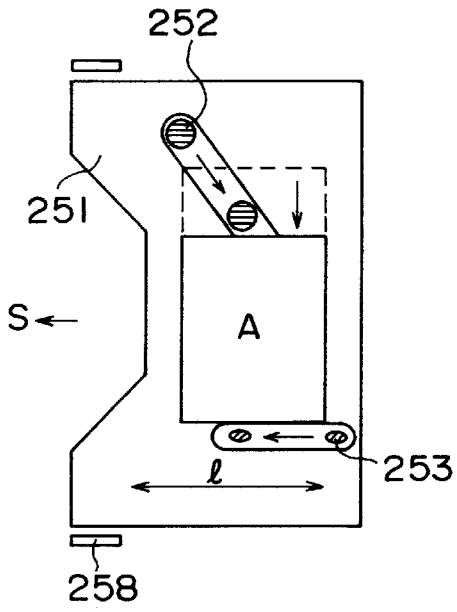
FIGS. 6A to 6C are constructional explanatory diagrams of the sorter.
Figure 6C:
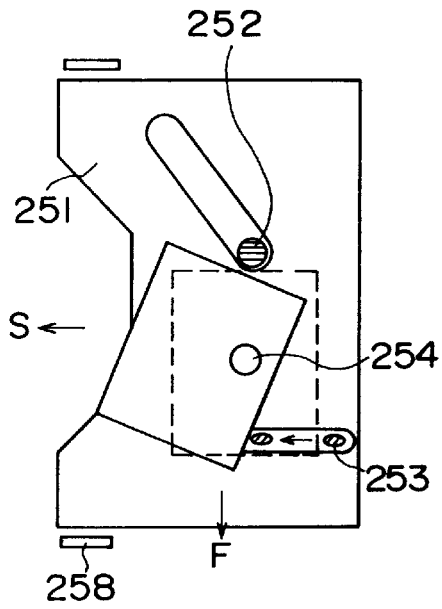
Figure 6B:
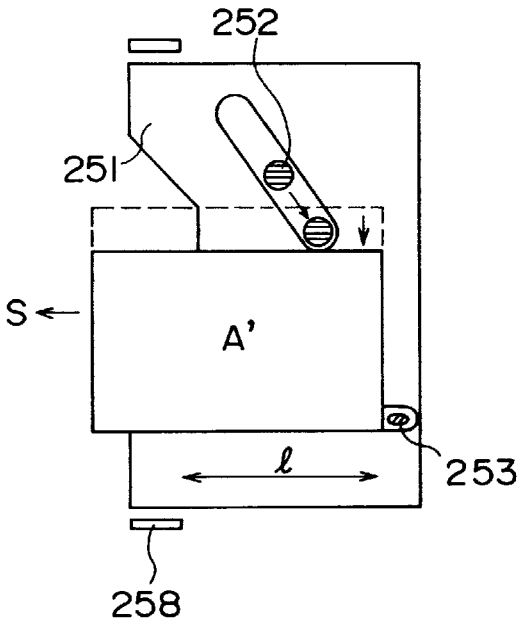

When unprocessed originals still remain in the RDF 200 after the copy of the desired number was finished, the next original is fed and similar processes are executed (step S16). When all of the image forming operations are finished, a check is made to see if the sheet movement inhibition flag has been set or not (step S17). If NO, the sheet is moved by the aligning bar 252 and reference bar 253 (step S18). The foregoing predetermined value l is equal to a length of opening portion in the case where the sheets ejected to the sorter bin are taken out in the front-side direction F. According to the foregoing control, as shown in FIG. 6A, when the length of sheet is shorter than the predetermined value l, as shown in FIG. 6C, the sheets are deviated so as to be taken out in the front-side direction F. When the length of sheet is longer than the predetermined value l as shown in FIG. 6B, the sheets can be taken out in a lateral direction S without deviating the sheets. Although the sheets can be easily taken out in the front-side direction F as compared with the lateral direction S, when the length of sheet is longer than the predetermined value l, the outer frame 258 becomes an obstacle and makes it difficult to take out the sheets in the front-side direction F as compared with the lateral direction S. To prevent such a situation, the control as mentioned above is performed.

[Embodiment 2]

Figure 7:
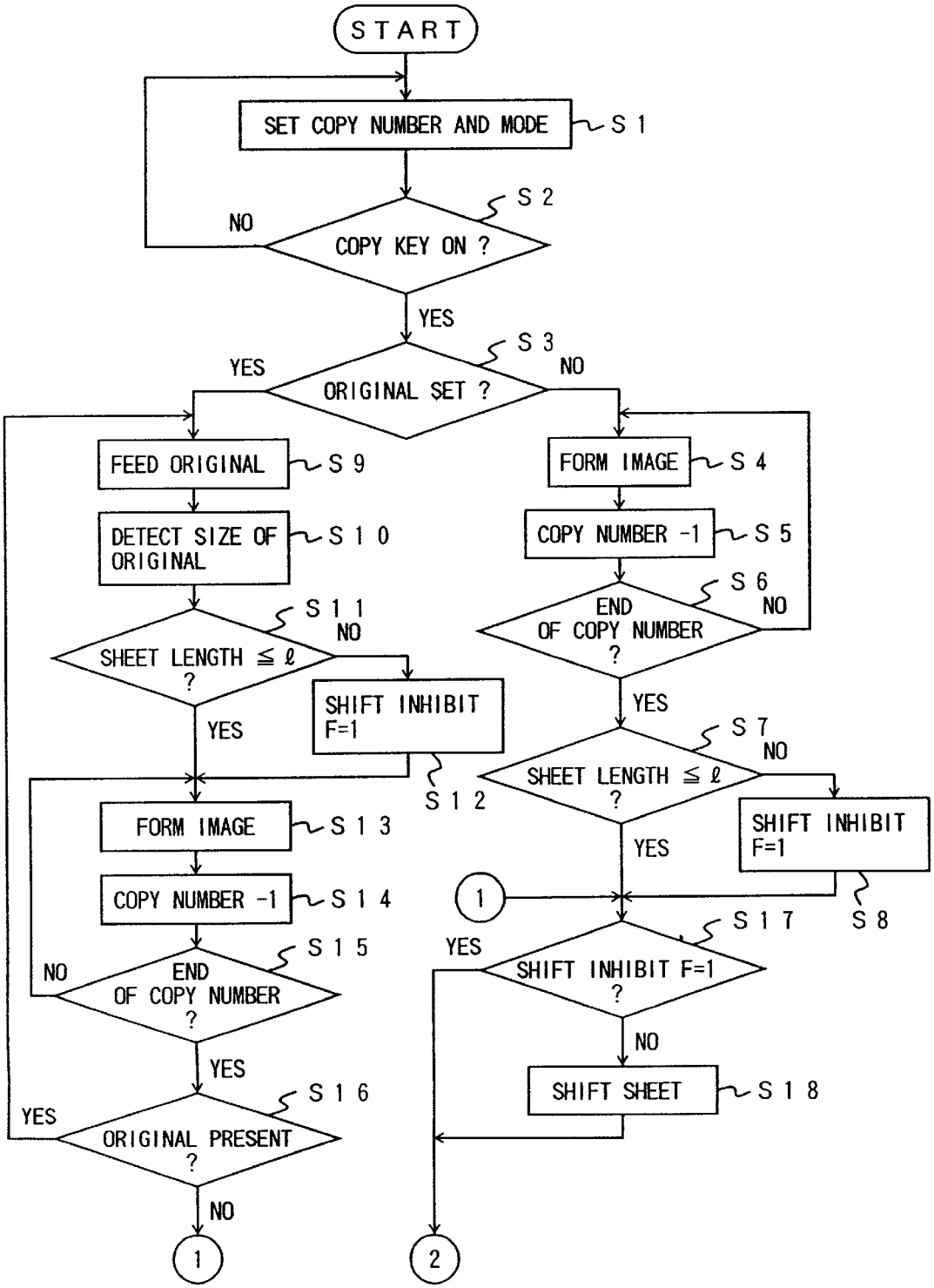
FIG. 7 is an operation sequence flowchart (No. 1) of the embodiment 2.
Figure 8:
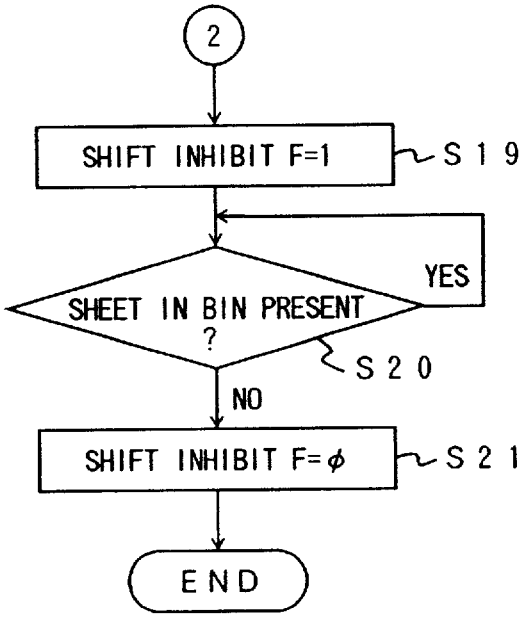
FIG. 8 is an operation sequence flowchart (No. 2) of the embodiment 2.

The second embodiment according to the invention will now be described with reference to FIG. 6C. FIG. 6C is a constructional diagram of the sorter 250 in the embodiment. Reference numeral 254 denotes a sensor to detect the presence or absence of the paper. An operation sequence of the embodiment 2 will now be described hereinbelow with reference to flowcharts of FIGS. 7 and 8. Since FIG. 7 is almost similar to FIG. 5 except the processes after steps S17 and S18, the same processing steps are designated by the same reference numbers.

After completion of the processes until the sheet movement (step S18), the sheet movement inhibition flag is set (step S19). After that, when the sensor 254 detects that the sheets on the sorter bin 251 were eliminated, the sheet movement inhibition flag is reset (steps S20, S21).

[Embodiment 3]

Figure 9:
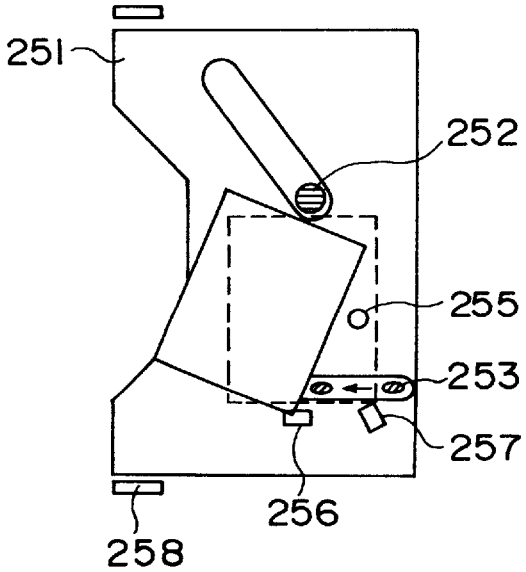
FIG. 9 is an explanatory diagram of a sorter construction of the embodiment 3.
Figure 10:
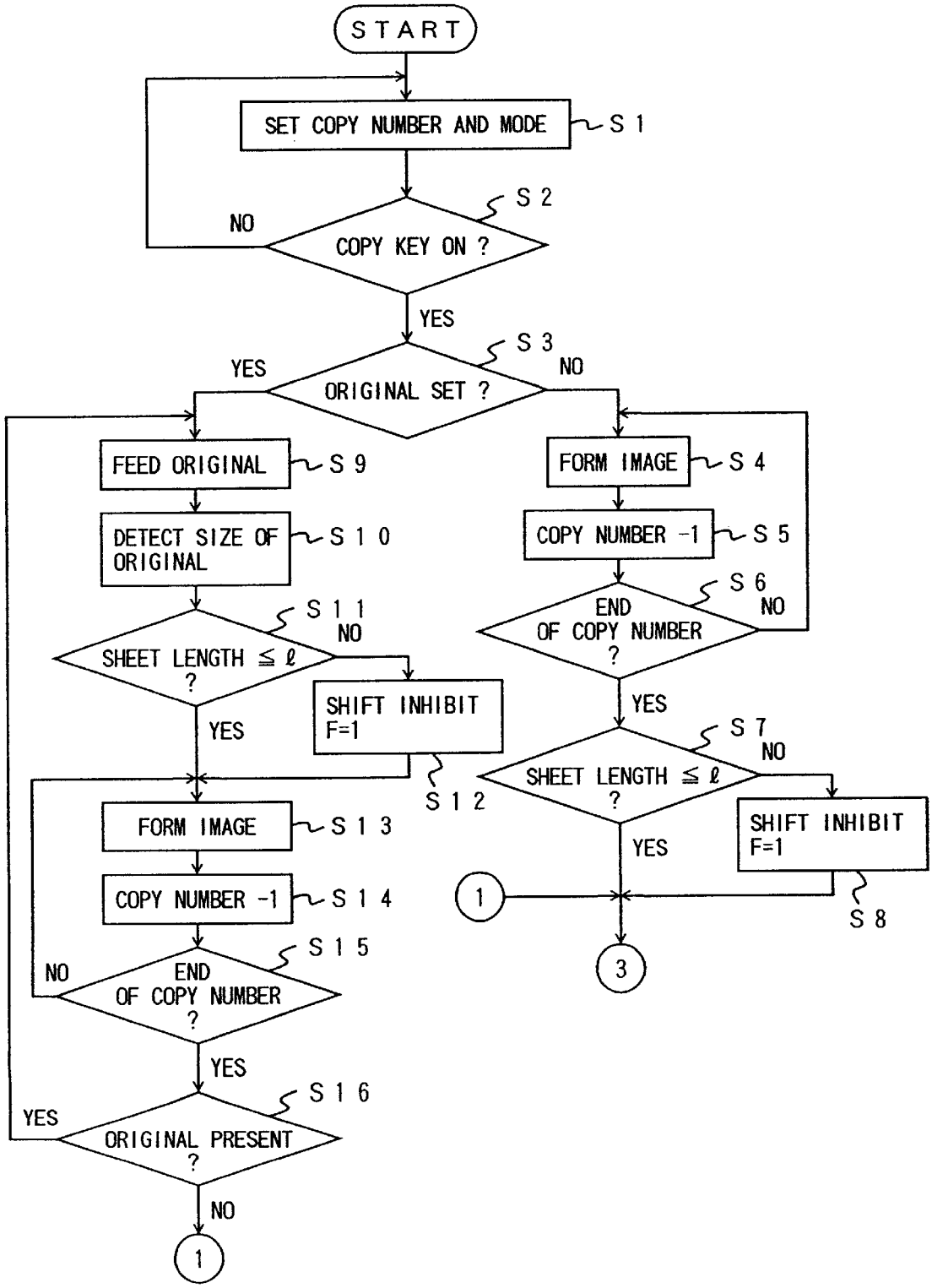
FIG. 10 is an operation sequence flowchart (No. 1) of the embodiment 3.
Figure 11:
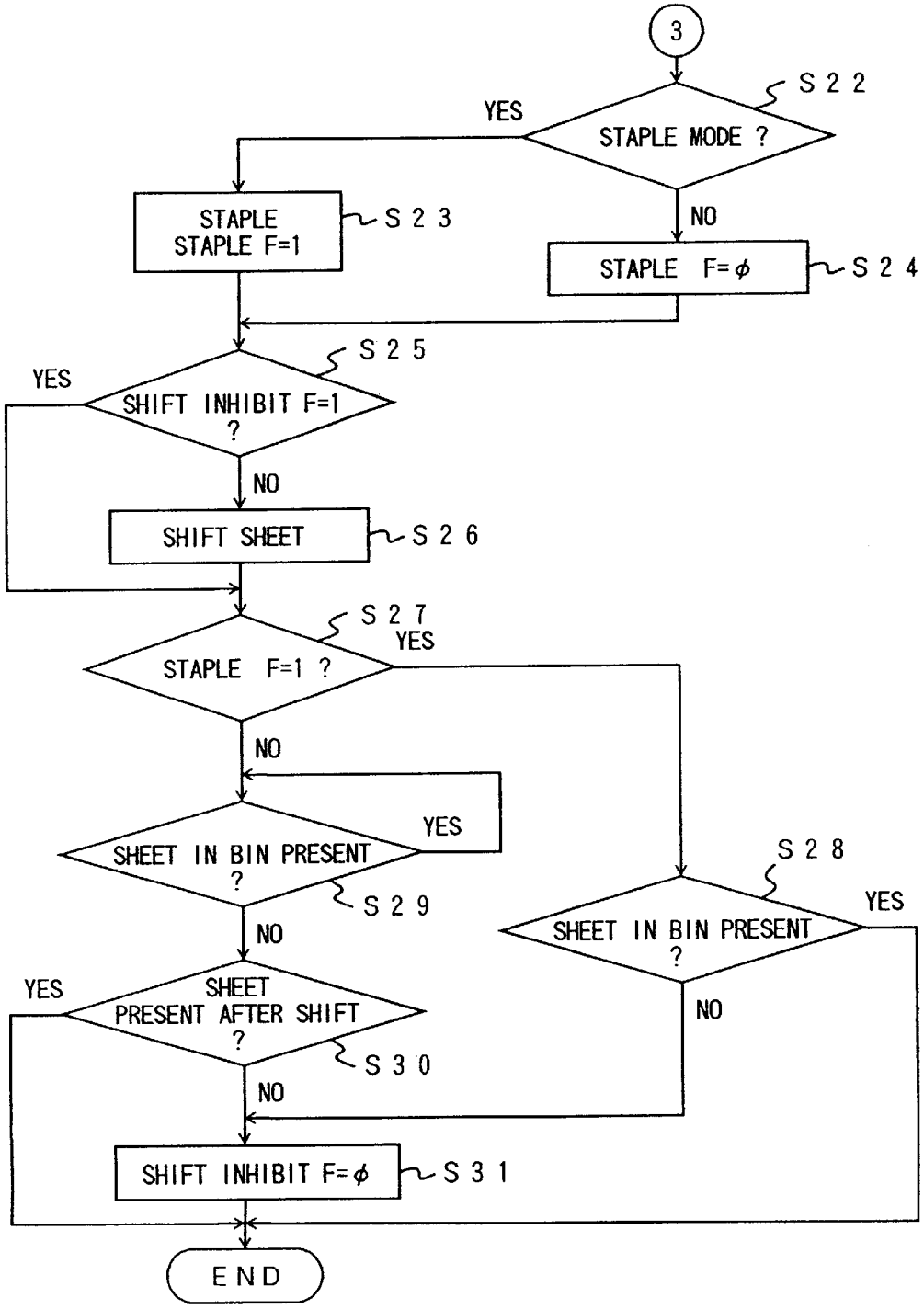
FIG. 11 is an operation sequence flowchart (No. 2) of the embodiment 3.

The third embodiment according to the invention will now be described with reference to FIG. 9. FIG. 9 is a constructional diagram of the sorter 250 in the embodiment. Reference numeral 255 denotes a sensor for detecting the presence or absence of the sheet at the ejecting position; 256 a sensor to detect the presence or absence of the sheet at the position after the sheet was moved; and 257 a stapler, which will be explained hereinafter. An operating sequence of the embodiment will now be described hereinbelow with reference to flowcharts of FIGS. 10 and 11. Processing steps similar to those in FIGS. 5 and 7 are designated by the same step numbers.

Figure 12:
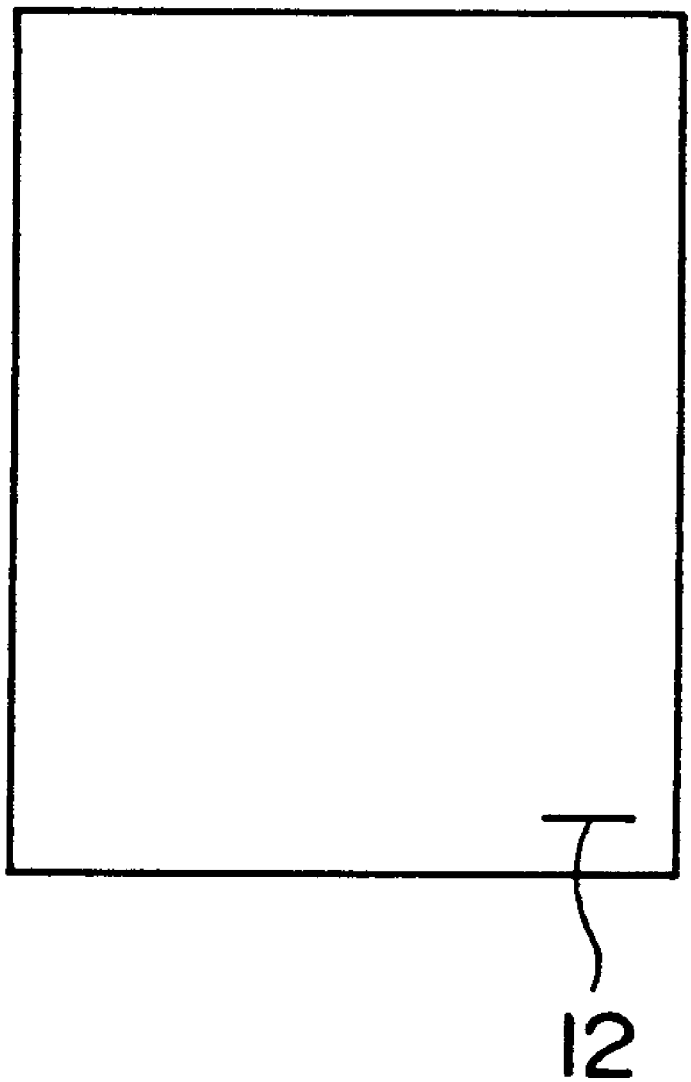
FIG. 12 is an explanatory diagram of a staple position.

After all of the image forming processes were finished, a check is made to see if a staple mode using the stapler 257 has been set or not (step S22). In the staple mode, the sheets are bound by a staple 12 as shown in FIG. 12 by using the stapler 257 in FIG. 9 and, at the same time, a staple flag is set (step S23). When the mode is not the staple mode, the staple flag is reset (step S24). After that, the movement of the sheets is executed or inhibited in accordance with the sheet movement inhibition flag (steps S25, S26).

A check is now made to see if the sheets are in a state in which they were bound by the stapler or not by detecting the staple flag (step S27). If YES, a check is made to see if the sheet movement inhibition flag is reset or not in accordance with the presence or absence of the sheets by the sensor 255 (steps S28, S31).

When the mode is not the staple mode, the next operation is inhibited until the absence of the sheets is detected by the sensor 255 (step S29). A check is made to see if the sheet movement inhibition flag is reset or not in accordance with the presence or absence of the moved sheets detected by the sensor 256 (steps S28, S31). When the movement inhibition flag is not reset, in case of the next work, the movement of the sheets is not executed but the sheets are divided and sorted.

As described above, since the movement of the sheets has been executed or inhibited in accordance with the size and direction of sheet, the presence or absence of the use of the sheet stapler, the state of the remaining sheets in the sorter apparatus of the sheets, or the like, the sheet dividing and sorting operations of each work can be executed and an efficient work can be executed.

What is claimed is:

1. A sheet stacking apparatus comprising:

a bin having an opening portion for taking out sheets on each of a front-side surface and a lateral side surface;

aligning means for aligning the sheets on said bin;

sheet deviating means for deviating the sheets, aligned by said aligning means, on said bin toward said front-side surface so that corners of the sheets protrude from said bin toward said front-side surface; and control means for inhibiting said sheet deviating means from deviating the sheets on said bin toward said front-side surface such that the corners of the sheets protrude from said bin toward said front-side surface, and permitting the operation of said aligning means such that the sheets can be taken out from said lateral side surface in a state that the sheets are being aligned, if a length of sheets in a direction parallel with said front-side surface is longer than a length of an opening portion on the front-side surface.

2. An apparatus according to claim 1, wherein said sheet deviating means comprises a rod-shaped member.

3. An apparatus according to claim 2, wherein said sheet deviating means comprises first and second rod-shaped members, said first rod-shaped member deviates the sheets on said bin toward said front-side surface, said second rod-shaped member deviates the sheets so that one of corners of the sheet faces said front-side surface, and when a length of the sheets in a direction parallel with said front-side surface is longer than a length of the opening portion on the front-side surface, said control means inhibits the operation of said second rod-shaped member.

4. An apparatus according to claim 1, wherein said sheet stacking apparatus is connected to an image forming apparatus, and after said image forming apparatus ejects one group of sheets to said sheet stacking apparatus, said sheet deviating means are made operative.

5. An apparatus according to claim 1, further comprising a plurality of said bins.

6. An apparatus according to claim 1, further comprising a sheet detecting means for detecting the sheets on said bin.

7. An apparatus according to claim 6, wherein said sheet detecting means detects a position on the sheets on said bin.

8. An apparatus according to claim 6, wherein said sheet detecting means detects a presence or an absence of the sheets on said bin.

9. An apparatus according to claim 6, wherein aid control means controls in accordance with a detection result of said sheet detecting means.

10. A sheet stacking apparatus comprising:

a bin having an opening portion for taking out sheets on each of a front-side surface and a lateral side surface;

sheet deviating means for deviating the sheets on said bin toward said front-side surface so that the sheets can be taken out from said front-side surface;

detecting means for detecting a length of each sheet to be stacked on said bin in the direction parallel with said front-side surface; and control means for inhibiting an operation of said sheet deviating means in accordance with the length of sheet detected by said detecting means exceeds a predetermined value, wherein said sheet deviating means includes two rod-shaped members, said first rod-shaped member deviates the sheets on said bin toward said front-side surface, said second rod-shaped member deviates the sheets so that one of corners of the sheets faces said front-side surface, and when a length of sheet exceeds said predetermined value, said control means inhibits an operation of said second rod-shaped member.

11. An apparatus according to claim 10, wherein said sheet stacking apparatus is connected to an image forming apparatus, and after said image forming apparatus ejected one group of sheets to said sheet stacking apparatus, said sheet deviating means are made operative.

12. An apparatus according to claim 10, having a plurality of said bins.

13. An apparatus according to claim 10, further having sheet detecting means for detecting the sheets on said bin.

14. An apparatus according to claim 13, wherein said sheet detecting means detects a position on the sheets on said bin.

15. An apparatus according to claim 13, wherein said sheet detecting means detects the presence or absence of the sheets on said bin.

16. An apparatus according to claim 13, wherein said control means controls in accordance with a detection result of said sheet detecting means.

17. A sheet stacking apparatus comprising:

a bin having an opening portion for out sheets on each of a front-side surface and a lateral side surface;

sheet deviating means for deviating the sheets on said bin toward said front-side surface so that corners of the sheets protrude from the bin toward said front-side surface;

control means for inhibiting an operation of said sheet deviating means in accordance with the length of sheets in the direction parallel with said front-side surface exceeds a predetermined value, wherein said sheet deviating means includes a first rod-shaped member and a second rod-shaped member, said first rod-shaped member deviates the sheets on said bin toward said front-side surface, said second rod-shaped member deviates the sheets so that one of corners of the sheet faces said front-side surface, and when a length of sheet exceeds said predetermined value, said control means inhibits an operation of said second rod-shaped member.

18. An apparatus according to claim 17, wherein said sheet stacking apparatus is connected to an image forming apparatus, and after said image forming apparatus ejected one group of sheets to said sheet stacking apparatus, said sheet deviating means are made operative.

19. An apparatus according to claim 17, further comprising a plurality of said bins.

20. An apparatus according to claim 17, further comprising a sheet detecting means for detecting the sheets on said bin.

21. An apparatus according to claim 20, wherein said sheet detecting means detects a position on the sheets on said bin.

22. An apparatus according to claim 20, wherein said sheet detecting means detects a presence or an absence of the sheets on said bin.

23. An apparatus according to claim 20, wherein said control means controls in accordance with a detection result of said sheet detecting means.

* * * * *

UNITED STATES PATENT AND TRADEMARK OFFICE

CERTIFICATE OF CORRECTION

PATENT NO. : 6,085,913

DATED : July 11, 2000

INVENTOR(S) : YASYUKI AIKO, ET AL.

It is certified that error appears in the above-identified patent and that said Letters Patent is hereby corrected as shown below:

TITLE PAGE:

Item 56, "3102070 4/1994 Japan" should read --3-102070 4/1991 Japan--.

COLUMN 2:

Line 31, "those" should read --the--.

COLUMN 3:

Line 26, "re-feed" should read --refeed--; and

Line 39, "multi-hand" should read --multihand--.

COLUMN 8:

Line 3, "are" should read --is--;

Line 33, "surface," should read --surface, and--;

UNITED STATES PATENT AND TRADEMARK OFFICE

CERTIFICATE OF CORRECTION

PATENT NO. : 6,085,913

DATED : July 11, 2000

INVENTOR(S) : YASYUKI AIKO, ET AL.

It is certified that error appears in the above-identified patent and that said Letters Patent is hereby corrected as shown below:

COLUMN 8 (cont'd):

Line 42, "ejected" should read --ejects--;
Line 44, "are" should read --is--;
Line 45, "having" should read --further comprising--;
Line 47, "further having" should read --further comprising--;
Line 59, "for" should read --for taking--; and
Line 65, "surface;" should read --surface; and--.

COLUMN 9:

Line 6, "surface," should read --surface, and--;
Line 15, "ejected" should read --ejects--; and
Line 17, "are" should read --is--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*